United States Patent [19]

Marseillan

[11] 4,076,206

[45] Feb. 28, 1978

[54] PANEL FORMS HAVING PANEL REINFORCING MEANS

[76] Inventor: Jorge Marseillan, Sarmiento 440, Buenos Aires, Argentina

[21] Appl. No.: 676,613

[22] Filed: Apr. 13, 1976

[30] Foreign Application Priority Data

Apr. 17, 1975 Argentina ..... 258414

[51] Int. Cl.[2] ..... E04G 11/08; E04G 17/08

[52] U.S. Cl. ..... 249/44; 249/47; 249/189; 249/190; 249/192; 249/216

[58] Field of Search ..... 249/33–35, 249/40, 44, 47, 129, 190, 192, 196, 213, 216

[56] References Cited

U.S. PATENT DOCUMENTS

| | | | |
|---|---|---|---|
| 2,992,468 | 7/1961 | Leonard | 249/40 |
| 3,171,186 | 3/1965 | Bowden | 249/196 |
| 3,899,155 | 8/1975 | Ward | 249/189 |

FOREIGN PATENT DOCUMENTS

| | | | |
|---|---|---|---|
| 185,557 | 5/1956 | Germany | 249/196 |
| 587,269 | 1/1959 | Italy | 249/196 |

*Primary Examiner*—Francis S. Husar
*Assistant Examiner*—John McQuade
*Attorney, Agent, or Firm*—Fitzpatrick, Cella, Harper & Scinto

[57] ABSTRACT

A form for walls and the like of the type formed by two parallel, facing molding surfaces each of the surfaces being formed by a plurality of panels, each panel having a rigid appendix extending transversly of the molding surface thereof and the free end of which constitutes a rigid vertical element, the ends of said element having assembly and connection means for cooperating with the adjacent end of the vertical element of a vertically adjacent panel. Mutual locking means are provided on the vertical edges of adjacent panels; and means are also provided for connecting facing panels and locking the same against relative movement.

12 Claims, 15 Drawing Figures

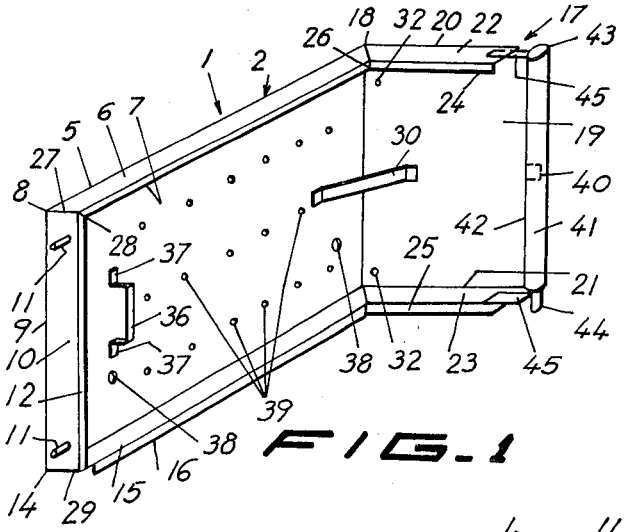
FIG. 1
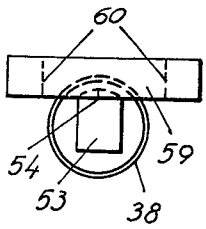
FIG. 5
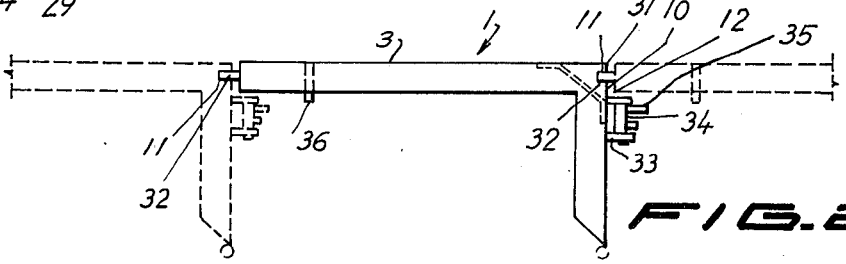
FIG. 2
FIG. 3
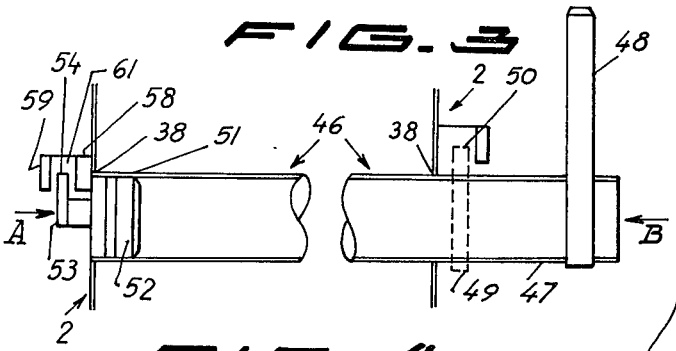
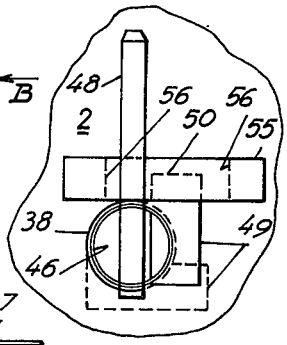
FIG. 4
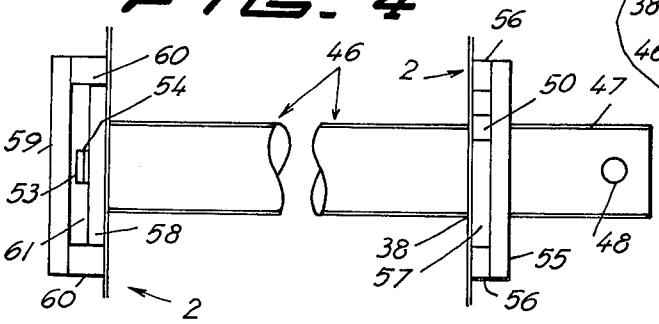
FIG. 6

FIG. 7
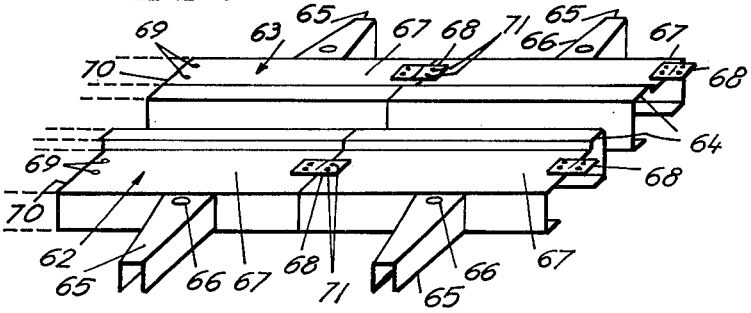
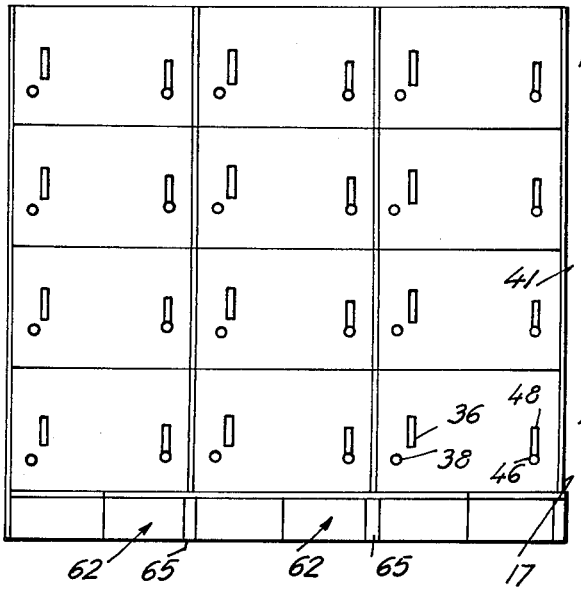
FIG. 10
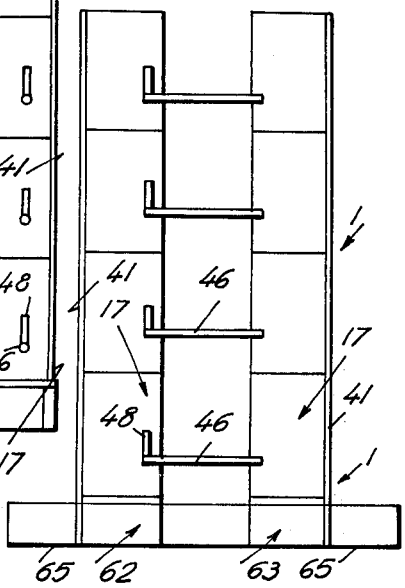
FIG. 8
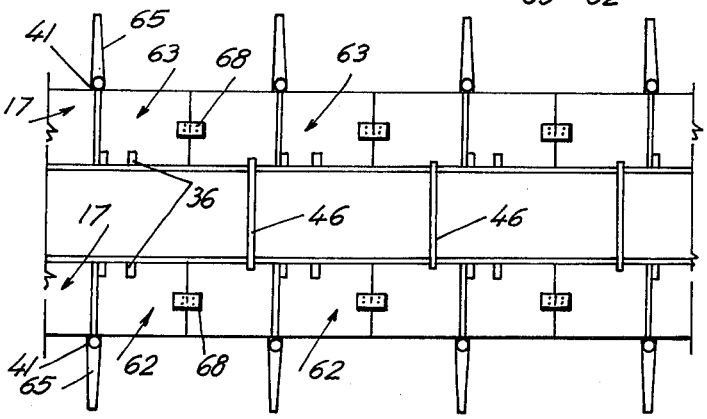
FIG. 9

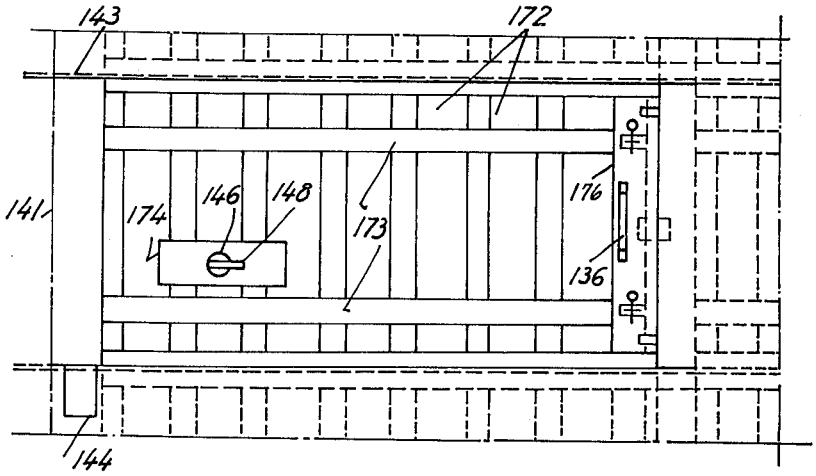
FIG. 11
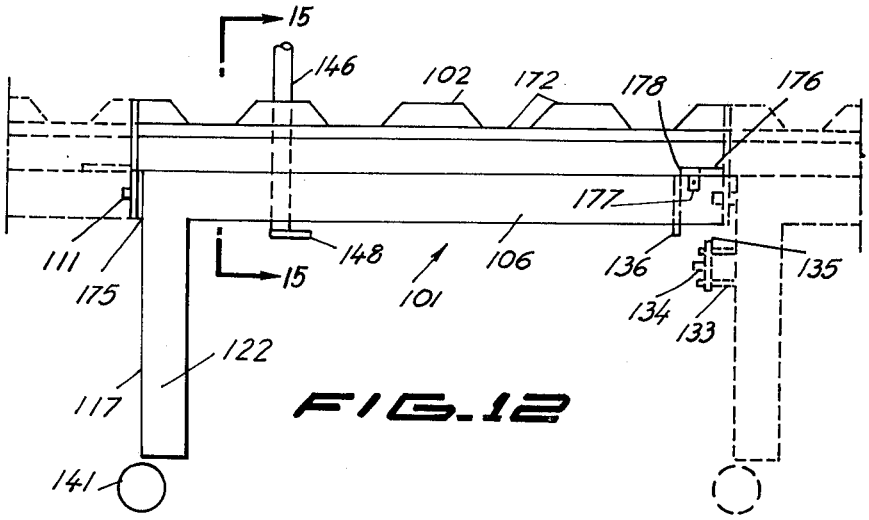
FIG. 12
FIG. 13
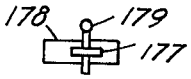
FIG. 14
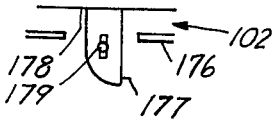
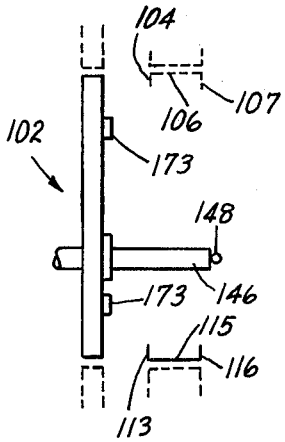
FIG. 15

PANEL FORMS HAVING PANEL REINFORCING MEANS

The present invention relates to wall forms, and more particularly, to such forms of the type wherein two surfaces face each other to delimit the surfaces of the wall to be formed. Modern techniques have replaced the use of individual stone or brick elements for the construction of walls and other vertical members by precast cement or cast in situ techniques which contribute economy of construction, a better finish, and especially celerity of execution.

The two aforementioned systems for using cement have reciprocal advantages and disadvantages that lead to the selection of one or the other solution according to each circumstance. The precast system permits the obtainment of thinner walls, which means economy of material, a better finish, and exact sizes. Likewise, most of the labor is effected in workshops remote from the construction site reducing the site personnel to the minimum. But this system requires heavy machinery, more transport from the cement deposit to the workshop and from the workshop to the site so that, due to the volume and weight of said elements, special means of transport are required as well as the reinforcement of the elements in order to support same during transport and handling. Furthermore, there are also complicated and unsafe joints and couplings and, what is worse still, the joints interrupt the monolithism of the construction, so that this system must be set aside for certain uses and areas.

The usual forms or molds known at present for the cast in situ system do not have the aforesaid disadvantages, and furthermore, permit the obtention of a high degree of monolithism, but, on the other hand, same are subject to diverse difficulties when put in practice. Thus, the forms are constituted with panels of vertical section and of similar height as that of the wall to be built. Therefore, they are heavy, require heavy cranes for moving; and in the operations for shoring, lining and fastening, besides accessory elements, skilled personnel and considerable labor are required.

These panels are fixed to each other by means of more or less ingenious methods, but require the use of many tools. In such forms, the wall is filled once throughout its height and requires more labor in order to prevent forming hollows in the finished cement. Such hollows are generally unavoidable, the difficulty increasing as it is endeavoured to reduce the thickness of the wall to be constructed. Likewise, the panels and joints must be strong in order to resist the thrust of the cement throughtout their height.

Accordingly, I have conceived and contribute by the present invention forms for walls and the like by which I am able to eliminate all the difficulties of the forms used at present, likewise offering several advantages that have heretofore not been realized in the known construction techniques. Due to their special characteristics, the panels to be used according to my concept are light and of reduced dimension, so that manual handling is possible. With these special panels, the forms are mounted in situ, piece by piece, fixing one to the other until the perimeter of the construction is completed with a layer of panels. The concrete is then poured to correspond to layer of panels followed by the assembly of another layer on top of the previous one, etc., thus reaching, by stages, the total height of the structure; said height having no theoretical limit. Although the principal panels are all equal, countless project combinations are permitted within the respective modules. The special panels of my forms are imbricated one to another such as the tiles on a roofing or the scales of a fish, each piece being fixed by the following piece. In some of the embodiments of the invention, when concreting is finished, the disassembly of the forms must be effected beginning from the last panel mounted until arriving to the first panel; but in this case, when the height of the building requires it, intermediate panels may be placed with a special device that permits the builder to interrupt the fixing of the panels between each other and proceed to disassemble in several areas at the same time.

Although the present specification and drawings only describe the embodiment of the normal or principal panel for casting straight walls, it shall be easily understood by those persons skilled in the art that, by using the same basic system, variations of pieces for corners may be projected, as well as partition joints with the walls, placing of doors and windows, lintels, railings, columns, beams, etc. Likewise, it has been verified that by making the panels with an adequate curve in its horizontal section, a cylindrical wall may be built of the type used for the construction of tanks and silos. Furthermore, as accessory elements of the invention, the use of basic pieces has been foreseen to assist in the initial steps in the forms assembly.

The principal characteristic of my new form briefly consists in the fact that each panel has its support incorporated therein, as well as elements that collaborate with the support and fix the adjoining panels in such a way that, once the forms are assembled, the assembly becomes rigid, self-supporting and self-aligned. Moreover, my forms not only do not require any type of props, but neither do they need plummets, rulers, deflection indicators, guides, or any of the accessory elements that are normally necessary for assembling the forms known up to the present.

According to my present concept, in constructions with a closed perimeter, a first form assembly generally begins in a point outside same and continues until arriving again at the same point. Subsequently, the process is repeated on the inner side of the first set of forms until completing the circuit, simultaneously passing crosspieces with special anchorage elements that permit fixation of the pairs of panels facing each other, the workman working on one side alone. On the other hand, as happens with the lacings and other anchorage elements with threads and fastenings used in conventional forms, a workman on each side is required for the same task. This enables one workman alone to assemble my new forms and, nevertheless, also increases the rapidity and safety of assembly.

With my new forms, a panel is fixed to the next one by means of fixed and/or sliding pins and plate flanges, that do not require any tools for placement or withdrawal, and the panels are supported and aligned to each other by reason of their shape.

Moreover, with my new forms, when the individual casting method is used for successive layers of panels, as the concrete loses plasticity in a short period and this reduces the thrust on the form walls stage by stage, the stress on the panels is also reduced and, consequently, do not require to be reinforced as the conventional panels do and therefore vibrators or any other known element that increases plasticity can be used, as in this case the fresh concrete falls on the concrete that is in course of setting and the pressure is not transmitted to the panels as the depth increases. Due to the reduced height of the panels, it is possible to mold walls of a more reduced thickness than that obtained with the precast systems.

By reason of the form in which the panels of the present invention are assembled and disassembled, the molding sides can be stamped to form drawings, rugosity, textures of any type of finish or decoration that permit presentation of a decorated front without any additional cost. The front view concrete remains as a sculptural work, no plaster is required, and the inner part can be finished with paint on the molded textures.

With the new forms, as all the pieces are arranged and progressively picked from the ground, any unskilled workman may "lay out" the project without the danger of making mistakes or committing errors of line or square, thus obtaining an exact structure. Instead of marking the plane with measurements, they may be marked per piece, which may be colored for identification and even an illiterate workman may assemble the form of a structure by simply observing the color in the plan which, for example, shall state as follows: three red in line, one green in square, etc.

By combining the new forms for walls and the like with a slab form adaptable to same, there is no theoretical limit in the height that can be obtained. The walls are built, the slab is filled, and so on, up to any theoretical height.

The new forms may be used for constructions not only with concrete, but also for any type of adequate mortar. In fact, according to tests carried out, even a mixture of mud and straw may be used.

Briefly, the new forms have the advantages of the premolded systems and those cast in situ, within the simplicity and versatility of brick construction.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject of the claims appended hereto. Those skilled in the art will appreciate that the conception upon which this disclosure is based may readily be utilized as a basis for the designing of other structures for carrying out the several purposes of the invention. It is important, therefore, that the claims be regarded as including such equivalent constructions as do not depart from the spirit and scope of the invention.

Specific embodiments of the invention have been chosen for purposes of illustration and description, and are shown in the accompanying drawings, forming a part of the specification, wherein:

FIG. 1 is a perspective view of a panel built in accordance with the invention in one of its embodiments;

FIG. 2 corresponds to the panel of FIG. 1 from its top border view with its relation to the two adjacent panels;

FIG. 3 shows a vertical longitudinal sectional view of the reciprocal union crosspieces of facing panels in their position of reciprocal embedment;

FIG. 4 is a plan view of the same assembly of the preceding FIG.;

FIG. 5 is a profile view taken in the direction of arrow A of FIG. 3;

FIG. 6 is a similar view in the direction of arrow B of FIG. 3;

FIG. 7 corresponds to a partial perspective of an accessory bases assembly of the new forms;

FIG. 8 is a schematic partial front view of a form built according to the invention with a plan illustration in FIG. 9 and a profile view in FIG. 10;

FIG. 11 is an outer front view of a panel in which the constitutive piece of its molding surface is detachable with respect to its support structure;

FIG. 12 shows the aforesaid panel, from a top edge view, with one part of the adjacent panels shown in lines of dashes;

FIGS. 13 and 14 show in respective top and plan view, an enlarged detail of the right union between the molding plate and the support structure; and FIG. 15 is a section according to line 15—15 of FIG. 12.

With reference to the panel 1 illustrated in FIGS. 1 and 2, it may be observed that same is basically constituted by a plate 2 that forms a rectangular molding surface 3. The upper edge of the plate 2 is bent at 5 to form a horizontal strip 6 which shall constitute the support base of the top panel, and finishes in a reinforcing flange 7. The left edge 8, bent at 9, forms a vertical strip 10 that supports the adjacent vertical area of the following panel, with two embedded projections 11, and finishes with a reinforcing flange 12. The lower edge, bent at 14, forms a horizontal strip 15 finishing with a reinforcing flange 16 facing downward, slightly more projecting than the aforesaid top flange 7 in order to rest against the edge 7 of the lower panel whereby flange 16 of one panel and flange 7 of a lower panel define mutual fastening means to assure that the respective molding surfaces 3 are coplanar.

On the other hand, the portion 17 on the right of the plate 2 is bent at 18 to form a vertical appendix 19 that is perpendicular to surface 3. The projections 20 and 21 conform both horizontal strips 22 and 23, respectively, on the same level as projections or strips 6 and 15 mentioned above, also finishing in reinforced flanges 24 and 25.

The panel thus formed, to obtain greater rigidity and consistency, may be welded in such places as along line 26 where the respective strips 6 and 22 and 15 and 23 meet; along line 27 where strips 6 and 10 meet; along line 28 where the reinforcing flanges 7 and 12 meet; along line 29 where strips 10 and 15 meet, etc. in accordance with techniques already known in the manufacture of this type of element, and one or more tension members 30 may be welded at their ends to the surface of portion 17 and the surface 3 of plate 2.

The portion 17, adjacent to bend 18, forms a vertical strip 21 (FIG. 2) equivalent to strip 10 of the adjacent panel, supported one against the other, for which purpose the strip 31 presents two perforations 32 in which the aforesaid projections 11 of strip 10 are embedded.

About half way up portion 17 and adjacent to strip 31, a forked piece 33 is welded to same, the drilled arms of which support a pin 34, the end 35 of which is a fastener or locking means for flange 12 of the panels.

A handle 36 is welded at its ends to the outer surface 3 of plate 2, welded while the surface 3 of the panel has two circular openings 38 and a plurality of small perforations 39, the operation of which elements to be later described.

The vertical appendix 19 has a lug 40 that passes through and is embedded about half way up a tubular piece 41, that is, strongly fixed to the appendix 19 by being welded along the lug 40 and of the edge 42 of the appendix 19. The tubular piece 41 thus forms a rigid vertical element, the open upper end 43 of which forms a female connecting element, while a projecting stem 44 fixed at its lower end forms a male element.

The fastening rigidity of the vertical element 41 is reinforced by means of two reinforcement pieces 45 respectively welded to the strip 22 and to the upper end 43 of tubular piece 41, and to strip 23 and the lower end of the tubular piece 41.

With reference to FIGS. 3 to 6, there is a crosspiece 46 formed by a hollow metal pipe at the end 47 of which is fixed a handle 48, and an eccentric projection 49 with a projecting end 50 is positioned adjacent same. On the opposite end 51 of the crosspiece 46, a locking nucleus 52 is fixed, the head 53 of which also forms a projection 54.

In accordance with this crosspiece construction, one of the series of panels (for example: those that will constitute the corresponding form to the outer surface of the wall to be cast) above its circular perforation 38 has a bar 55 (FIGS. 4 and 6) welded to the plate 2 with the interposition of two separators 56, forming a hollow 57. On the other hand, in the other series of panels (corresponding to the inner surface of the wall to be built) the upper portion of the perforation 38 is partially plugged by a bar 58 welded to plate 2, and on the bar 58 a second bar 59 welded on plate 2 with the collaboration of two separators 60 form another hollow 61. In accordance with the foregoing description it will be understood that by placing the two series of panels (outer and inner) as shall be described below, so that they face each other, and having the circular perforations 38 at an adequate distance, the following will be the result.

If the crosspiece 46 is introduced with its handle 48 in the right horizontal position, first in perforation 38 of an outer panel and subsequently in perforation 38 of the inner facing panel until the projection 49 (FIGS. 3 and 6) rests on plate 2, it shall be sufficient to turn the handle 48 upward, as shown, so that projection 50 is simultaneously locked in the hollow 57 and the projection 54 is locked in the hollow 61. Consequently, while the crosspieces 46 are maintained in a position of reciprocal locking, the respective panels shall not be able to register any movement in the direction perpendicular to their respective planes. On the other hand, if subsequently handle 48 of the crosspieces 46 is once more carried to a right horizontal position, nothing will prevent the withdrawal of the crosspieces and the movement related to the panels in the abovementioned direction. In certain instances only selected opposing panels may be locked together. For example, it may be necessary only to lock the opposing end panels of each column of panels.

Preferably, subsequent to an adequate preparation of the ground of the area in which the wall will be cast, the first layer of the form shall be constituted by two series of base elements 62 and 63 such as those illustrated in FIG. 7.

The elements 62 and 63 have a relief strip 64 of a similar width as the lower strip 15 of panels 1 and a side support arm 65 in order to increase the support and assist in levelling of the assembly. On each arm 65, and at a distance from the strip 64 equal to that which separates the stem 44 of the strip 15 in the panels, I form a perforation 66 prepared to receive the stems 44 of the first line of panels 1. The length of the base elements 62 and 63 is similar to that of the panels and at one of its ends 67, has drilled lugs 68 which are superimposed with respect to the perforations 69 provided in the opposite end 70 by means of respective keys 71 used as reciprocal union means of the elements 62 and 63, respectively.

The form assembly, once the two series of base elements 62 and 63 are adequately arranged, is effected in the following manner. A panel 1 is taken (one hand on the handle 36 and the other on the element 41) and carried so that its stem 44 is introduced into perforation 66 of the first element 62, the panel rotating around stem 44 until its lower strip 15 is partially supported on strip 64 of one pair of elements 62 supporting the flange 16 on the side of the strip 64. Once this is done, a second panel 1 is taken introducing its stem 44 into perforation 66 of the following element 62, rotating this second panel until its vertical strip 31 rests against the vertical strip of the first panel 10 which will introduce the projections 11 into the perforations 32, while the lower strip 15 of the second panel is partially supported on the strip 64 of the two successive elements 62. Subsequently, the pin 34 of the second panel is operated so that its end 35 is locked in the flange 12 of the first panel 1. Thus, the series of panels 1 are successively mounted on the base elements 62 which will form the first row of panels of the form surface corresponding to the outer surface of the wall to be built. In a similar manner, the first row of panels of the other form surface is assembled on the base elements 63, therefore the perforations 38 of the two rows of panels shall be exactly facing each other. Thereafter, the crosspieces 46 are introduced into the facing perforations 38 locking same by means of a ninety degree rotation thereof in the manner mentioned above.

It is obvious that, at this point, the first row of the two series of panels 1 has become a totally rigid assembly in which the panels 1 supported by the base elements 62 and 63 cannot make any kind of relative movement in any horizontal direction.

Consequently, a second row of panels 1 may be assembled upon the first row, the only difference consisting in that the stems 44 of the second row shall be pivotally mounted in female elements 43 of the first row, resting the lower strips 15 of the second row on the upper strips 6 of the first row, with reciprocal support of the reinforcement flange 16 on the respective flange 7. Once the crosspieces of this second row of panels 1 are locked, the panel assembly of both rows of the two series shall also form a totally rigid, self-supporting assembly, as the panels of the second row shall not require any external supports (props, tension members, etc.), the necessary support being supplied by the panel assembly 1 of the first row with its appendix 19 and vertical elements 41 being fully sufficient due to the rigidity of the parts.

FIGS. 8 to 10 illustrate the forms built in accordance with the invention with four rows of panels 1. I have effected this experimental construction with six rows of panels 1 with a molding surface of 0.50 × 0.50 meters, which give a height of slightly over 3.00 meters (by the base elements 62 and 63) having verified that the stability of the assembly was fully satisfactory, besides maintaining all of the rigidity and self-supporting conditions. Of course the stability of the forms would be still more complete if once the panels 1 of the first row are mounted before setting the second row, a partial concrete laying of the wall is effected up to the height of the first row of panels.

In any case, when using the present form, in general it is preferred that concrete be individually layed in the successive layers of panels for the aforesaid reasons.

The panels 101 of the embodiment illustrated in FIGS. 11 to 15 are totally equivalent to those mentioned above, with the sole substantial difference that the plate 102 which constitutes the molding surface, forms a series of projections and entrances 172 and is detachable from the support structure 104, 106, 107, 113, 115, 116 and its vertical complements of the panel which is formed by a metal profile.

Correlatively, plate 102 is supplied with reinforcement rods 173 as well as a drilled reinforcement plate 174 coinciding with the perforation crossed by the crosspiece 146.

Likewise, as union elements between the plate 102 and its support structure, the former includes a first vertical lug 175 (FIG. 12) provided with perforations that receive the projections 111. The other vertical edge of the plate 102 has a second lug 176 supplied with perforated lugs 177 which, having crossed the respective perforations 178 of the support structure, are fixed in position by means of pins 179.

The assembly and the use of panels for molding a wall is totally equivalent to that mentioned above. The only difference consists in that dismantling is effected in two stages. Thus, once the pins 179 have been withdrawn, the support structures of the panels are first withdrawn, the plates 102 remaining abutted against the molded wall, and being withdrawn in a second stage.

This type of detachable panel is used to obviate the possibility that during the disassembly operation of the panels 101, the moldings 172 of plate 102 may adversely affect the respective moldings that have remained molded on the wall.

It is hereby stated that the aforesaid specification describes some of the preferred embodiments of the invention, not restrictive but demonstrative and as an example, and that several modifications in form, construction and detail may be introduced without exceeding the scope of the invention, such as are clearly detailed in the following claims.

I claim:

1. A form for walls and the like, formed by two parallel, facing molding surfaces delimiting the outer surfaces of the wall to be molded, wherein each of said two surfaces is formed by a plurality of panels arranged to define mutually facing columns and rows, the edges of each panel having support means for cooperation with the edges of adjacent panels and having rigid means extending substantially transverse to the molding surface thereof; the free end of said rigid means comprising spaced connection means each for cooperation with the adjacent connection means of rigid means of a vertically adjacent panel, said connection means being comprised by a stem, and a stem receiving opening, both the stem and the stem receiving opening being substantially spaced apart from the molding surface of the panel; the stem being adapted to be received in the stem receiving opening of a vertically adjacent panel to permit one panel to be pivoted with regard to the panel vertically adjacent and below thereto; mutual locking means on the vertical edges of adjacent panels, at least the end panels of each column of panels formed with opposed openings, means extending through said opposed openings mutually to connect facing panels, said panels and said last mentioned means having cooperating locking means, whereby the panels forming the facing molding surfaces constitute a self-supporting assembly.

2. A form for walls and the like according to claim 1, wherein each rigid means has a vertical element at a level substantially similar to the respective upper and lower levels of its panel, each rigid means and whereby, when assembled, the panels forming the facing molding surfaces constitutes a rigid and self-supporting assembly.

3. A form for walls and the like according to claim 2, wherein opposed openings are formed in each pair of facing panels and means extending through said opposed openings are provided to mutually join each pair of facing panels.

4. A form for walls and the like according to claim 3, wherein the lower horizontal edge of each panel is supplied with a downward facing flange which forms mutual rigidifying means with the upper horizontal edge of the vertically adjacent panel positioned thereunder.

5. A form for walls and the like according to claim 2, wherein said rigid means comprises by a plate perpendicular to the molding surface of its respective panel and connected by one of its edges to one of the vertical edges of its respective panel while the opposite edge thereof supports said vertical element.

6. A form for walls and the like according to claim 2, wherein the opposite ends of each vertical element form a female cavity and a projecting male element, respectively, that constitute said connection means for cooperation with the connection means of vertically adjacent panels.

7. A form for walls and the like according to claim 5, wherein the opposite ends of each vertical element form a female cavity and a projecting male element, respectively, that constitute said connection means for cooperation with the connection means of vertically adjacent panels.

8. A form for walls and the like according to claim 2, wherein said means extending through said opposed openings in said facing panels are supplied with an operation lever on one end to effect engagement and locking of said cooperating locking means.

9. A form for walls and the like according to claim 2, wherein each panel includes a plate defining the molding surface thereof and support means for attachably and detachably supporting said plate defining the molding surface thereof.

10. A form for walls and the like according to claim 2, wherein the panels on the surfaces opposed to said facing molding surfaces, include gripping means spaced from their respective vertical elements.

11. A form for walls and the like according to claim 2, wherein said means extending through said opposed openings comprises a crosspiece rotatable in said opening and eccentric means are provided on said crosspiece for positioning exterior of respective pairs of facing molding surfaces, said panels being provided with engaging means to receive said eccentric means in one rotative position of said crosspiece to lock respective panels forming said facing molding surfaces.

12. A form for walls and the like according to claim 11, wherein an operating lever is affixed to said crosspiece to effect rotation thereof between locking and unlocking positions.

* * * * *

UNITED STATES PATENT AND TRADEMARK OFFICE

CERTIFICATE OF CORRECTION

PATENT NO. : 4,076,206

DATED : February 28, 1978

INVENTOR(S) : JORGE MARSEILLAN

It is certified that error appears in the above-identified patent and that said Letters Patent are hereby corrected as shown below:

Column 8, line 6, after "its panel," delete "each rigid means and".

Column 8, line 22, after "comprises" delete "by".

Signed and Sealed this

*Fifth* Day of *June 1979*

[SEAL]

*Attest:*

RUTH C. MASON
*Attesting Officer*

DONALD W. BANNER
*Commissioner of Patents and Trademarks*